US005117979A

United States Patent [19]

Brightbill

[11] Patent Number: 5,117,979

[45] Date of Patent: Jun. 2, 1992

[54] TOOLBOX AND TRAY ASSEMBLY

[75] Inventor: Keith Brightbill, Wooster, Ohio

[73] Assignee: Rubbermaid Incorporated, Wooster, Ohio

[21] Appl. No.: 681,667

[22] Filed: May 13, 1991

[51] Int. Cl.[5] ..... B65D 85/28

[52] U.S. Cl. ..... 206/372; 206/373; 206/501; 206/503; 206/509; 312/DIG. 33

[58] Field of Search ..... 206/372, 373, 374, 375, 206/504, 506, 509, 510, 515, 518, 519, 501, 503; 220/94 A; 312/DIG. 33

[56] References Cited

U.S. PATENT DOCUMENTS

| | | | |
|---|---|---|---|
| D. 158,368 | 5/1950 | Felts et al. . | |
| D. 176,844 | 2/1956 | Evans | 206/273 |
| D. 212,995 | 12/1968 | Myers . | |
| D. 218,266 | 8/1970 | Belokin, Jr. . | |
| D. 237,121 | 10/1975 | Metzner . | |
| D. 242,083 | 10/1976 | Jean . | |
| D. 253,855 | 1/1980 | Hopf . | |
| D. 254,122 | 2/1980 | Wintz . | |
| D. 284,422 | 7/1986 | Pomaville . | |
| 1,268,124 | 6/1918 | Jennings | 312/DIG. 33 |
| 1,322,354 | 11/1919 | Scholtes . | |
| 1,614,910 | 1/1927 | Yarder . | |
| 1,639,227 | 8/1927 | Lawrence | 206/373 |
| 2,501,879 | 3/1950 | Sulenbic | 206/373 |
| 2,740,517 | 3/1956 | Evans | 206/373 |
| 2,777,597 | 1/1957 | Ruff | 206/509 |
| 3,301,619 | 1/1967 | Mead . | |
| 3,305,076 | 2/1967 | Fleenor . | |
| 3,330,608 | 7/1967 | Druger, Jr. . | |
| 3,346,733 | 10/1967 | Woolworth . | |
| 3,392,874 | 7/1968 | Peebles | 206/518 |
| 3,490,169 | 1/1970 | Tweed . | |
| 3,493,102 | 2/1970 | Belokin, Jr. . | |
| 3,583,556 | 6/1971 | Wagner . | |
| 3,587,915 | 6/1971 | Theobald | 206/510 |
| 3,606,005 | 9/1971 | Meksula . | |
| 3,606,511 | 9/1971 | Henning et al. . | |
| 3,628,843 | 12/1971 | Wynne et al. . | |
| 3,756,462 | 9/1973 | Cain | 206/501 |
| 3,777,882 | 12/1973 | McIntyre | 206/370 |
| 3,892,331 | 7/1975 | Beck . | |
| 3,948,579 | 4/1976 | Schirmer . | |
| 3,985,409 | 10/1976 | Kneier . | |
| 4,023,304 | 5/1977 | Singer . | |
| 4,085,987 | 4/1978 | Vartdal . | |
| 4,118,086 | 10/1978 | Kneier . | |
| 4,139,096 | 2/1979 | Sieger . | |
| 4,150,746 | 4/1979 | Buglione . | |
| 4,173,284 | 11/1979 | March . | |

(List continued on next page.)

FOREIGN PATENT DOCUMENTS 188054 12/1956 Fed. Rep. of Germany .

OTHER PUBLICATIONS

Page 33, Rubbermaid Incorporated, 1147 Akron Road, Wooster, Ohio 44691. Publication date 1988.

Catalog Page, Rubbermaid Incorporated, 1147 Akron Road, Wooster, Ohio 44691. Publication date 1988.

*Primary Examiner*—David T. Fidei

*Attorney, Agent, or Firm*—Richard B. O'Planick

[57] ABSTRACT

The subject invention comprises a tool tray having top and bottom surfaces, with side walls extending upwardly from the bottom surface to the top surface. An intermediately disposed handle extends upwardly between the side walls of the tray, and has a horizontal gripping portion and supportive end portions. A profile passageway is also provided to extend through the bottom surface of the tray in communication with the hand opening, whereby upon stacking positionment of the bottom surface of one of the trays upon the top surface of a substantially like configured second tray, the handle gripping portion of the second tray projects through the profiled passageway of the first tray into close underlying proximity with the handle gripping portion of the first tray. So positioned, the handle gripping portions nest and can be simultaneously lifted from the confines of a toolbox in single handed fashion.

17 Claims, 5 Drawing Sheets

U.S. PATENT DOCUMENTS 4,204,617 5/1980 Hirota ..... 206/510
4,240.222 12/1980 Covington .
4,245,422 1/1981 Souza .
4,266,835 5/1981 Schmidt .
4,283,098 8/1981 Sun .
4,366.998 1/1983 Kaiser .
4,460.085 7/1984 Jantzen .
4,474,291 10/1984 Fortson .
4,619,363 10/1986 Wolfseder ..... 206/373
4,643,494 2/1987 Marleau .
4,659,154 4/1987 Jenkins .
4,662,515 5/1987 Newby, Sr. .
4,667,822 5/1987 Coopmans .
4,714,158 12/1987 Oltman et al. .
4,717,020 1/1988 Viira .
4,729,474 3/1988 Lanius et al. .
4,739,577 4/1988 Lanius .
4,744,613 5/1988 Brantingham et al. .
4,768,651 9/1988 Lanius .
4,775,199 10/1988 Lanius .
4,782,619 11/1988 Richards .
4,784,304 11/1988 Schweitzer .
4,840,273 6/1989 Zavacki .
4,895,256 1/1990 Johnston ..... 206/203
5,011,013 4/1991 Meisner et al. ..... 206/506
5,040,681 8/1991 Grusin ..... 206/506

TOOLBOX AND TRAY ASSEMBLY

This application is a continuation of application Ser. No. 492,192, filed Mar. 13, 1990, now abandoned.

FIELD OF THE INVENTION

This invention relates generally to toolboxes of the type having a removable utility tray for transporting tools from the toolbox to a work site; and more specifically to a toolbox having more than one such utility tray.

BACKGROUND OF THE INVENTION

Toolboxes incorporating a removable utility tray are generally well known in the industry. Typically such boxes are four-sided containers having a pivotally attached lid, and an internally directed ledge for supporting a rectangular tool tray. The tool tray is generally configured as a four-sided rectangular box, and includes a handle which extends upwardly from the ends of the tool tray. The tool tray can be lowered into the toolbox, and is there supported by the internally directed ledge of the box. Various hand tools can be stored within the confines of the tray. A user withdraws the tray by manually lifting up on the handle, and thereupon can carry the tray and its contents to a remote work site.

While the above configuration, known to the industry, works well and has been well accepted, certain shortcomings prevent it from achieving an optimal utility. One shortcoming is that the relatively small storage capacity represented by the tray limits the number of tools which can be transported from the toolbox to a work location. A second shortcoming is that the tray is generally exposed at the top, and therefore tools can fall from the tray in-transit from the toolbox to the work site. Also, because of this risk, small items such as nails or screws cannot be stored in the tray, because of the possibility of their spilling out of the tray enroute to a work site.

SUMMARY OF THE INVENTION

According to the subject invention a four-sided stackable tool tray is provided comprising bottom and top surfaces, with side and end walls extending upwardly from the bottom surface to the top surface. An intermediately disposed profiled handle extends upwardly between the side walls of the tray, the handle having an upper horizontal gripping portion and supportive end portions. A hand opening is located below the gripping portion, between the handle end portions. A profiled passageway is also provided to extend through the bottom surface of the tray, in communication with the hand opening, whereby upon stacking positionment of the bottom surface of a first tray upon the top surface of a substantially like-configured second tray, the handle gripping portion of the second tray projects through the profiled passageway of the first tray into close underlying proximity with the handle gripping portion of the first tray. The handle gripping portions of the top and bottom tray, so positioned, nest and can be simultaneously lifted from the confines of the toolbox in single handed fashion. Furthermore, since the lower tray is completely covered by the upper tray in storage as well as in transit, small items contained in the lower tray cannot spill when the upper and lower trays are moved. According to a further aspect of the present invention, the tray handle gripping portions are configured such that they are offset and define an opening therebetween, whereby admitting a user's fingers for manual separation. Consequently, a user can either lift both trays simultaneously, or alternatively, individually lift the first tray from the second tray by separating the handle portions.

Accordingly, it is an objective of the present invention to provide a toolbox and tray assembly consisting of upper and lower trays which, when nested together, can be picked up with one hand.

A further objective of the present invention is to provide a toolbox and tray assembly having upper and lower trays which interlock together to prevent the trays from separating while the trays are transported from one location to another.

Yet a further objective of the present invention is to provide a toolbox and tray assembly having stackable trays offering an assortment of storage compartments suitable to receive small items and tools.

Yet a further objective of the present invention is to provide a toolbox and tray assembly having trays which nest by their handles, characterized by an offset in the handle alignment, forming an opening by which a user can readily separate the trays.

Another objective of the present invention is to provide a toolbox and tray assembly comprising stackable trays which can be stored within the confines of a toolbox, and yet can be simultaneously and single handedly transported to a remote work location.

Yet a further objective of the present invention is to provide a toolbox and tray assembly having stackable trays which are free standing in the stacked condition, and receivable into toolbox in the stacked configuration.

Yet a further objective of the present invention is to provide a toolbox and tray assembly which can be readily manufactured out of inexpensive plastics material and which can be readily assembled by the user.

A further objective of the present invention is to provide a toolbox and tray assembly comprising stackable trays, wherein the upper tray, in addition to functioning as a storage container, also functions as a lid to the underlying tray.

These and other objectives, which will become apparent to one skilled in the art, are achieved by a preferred embodiment which is described in detail below, and which is illustrated in the accompanying drawings.

BRIEF DESCRIPTION OF THE ACCOMPANYING DRAWINGS

DETAILED DESCRIPTION OF THE PREFERRED EMBODIMENT

Figure 1:
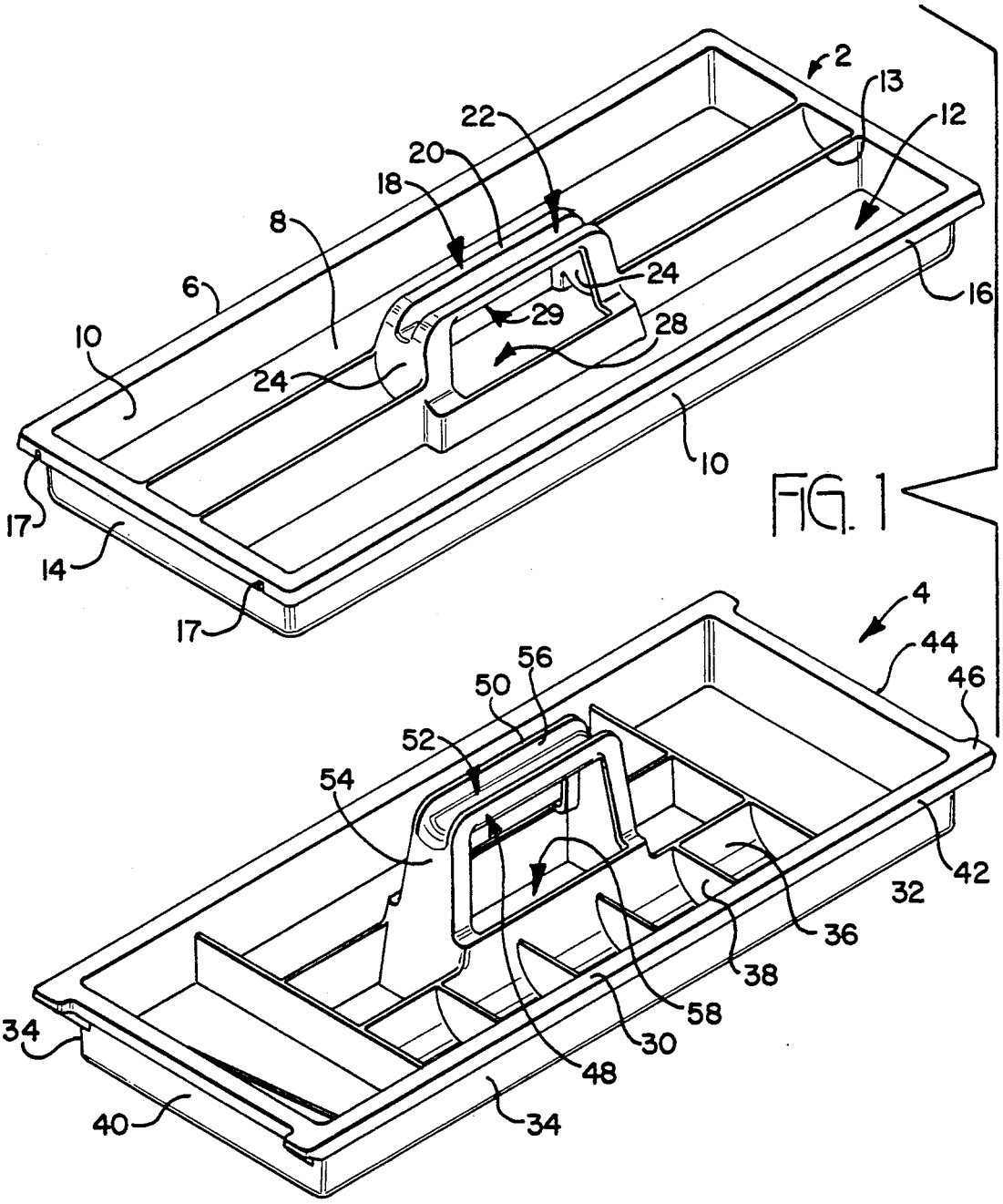
FIG. 1 is an exploded perspective view of the upper and lower trays comprising the subject invention.
Figure 3:
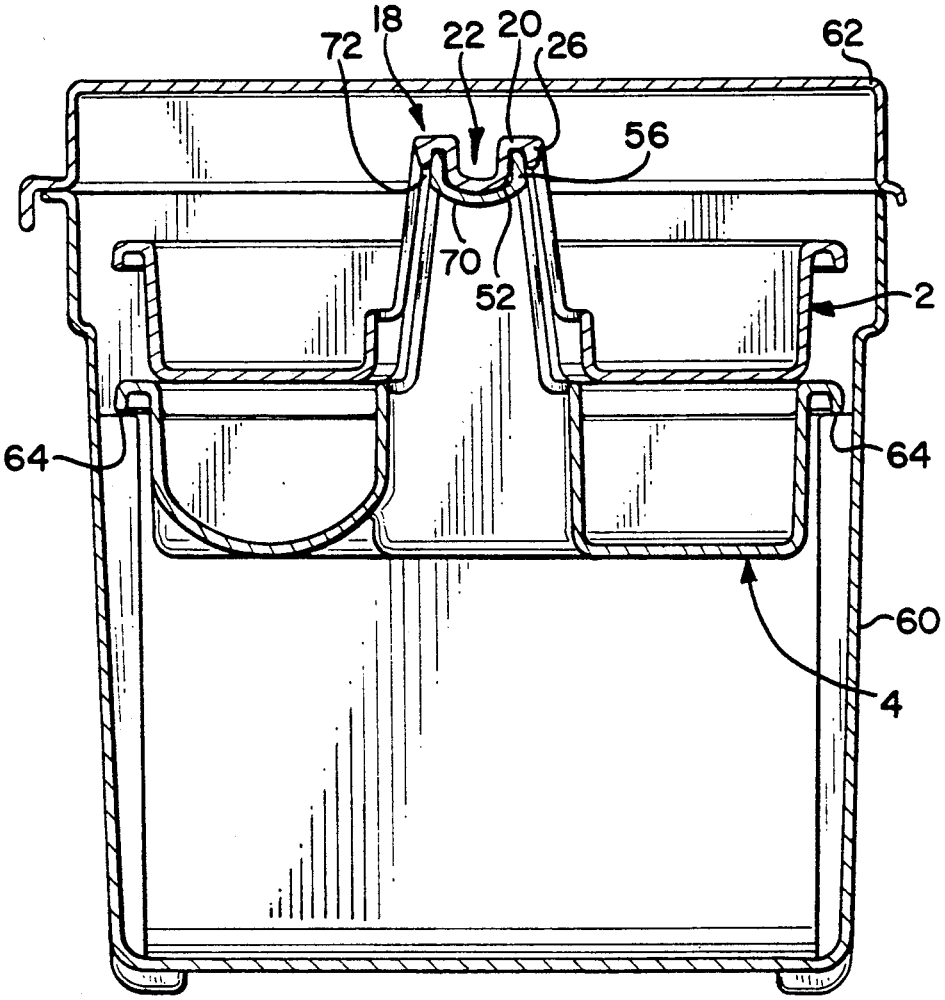
FIG. 3 is a transverse sectional assembly view of the stacked upper and lower trays within the confines of a toolbox, configured pursuant to the teachings of the present invention.

Referring initially to FIGS. 1 and 3, a first tool tray 2 and a second tool tray 4 are depicted, each being unitarily molded of conventional plastics material. The first tool tray 2 is configured as a substantially rectangular four-sided container, having a top surface 6, a bottom surface 8, and vertical side walls 10 extending upwardly from the bottom surface 8 to the top surface 6. A plurality of storage compartments 12 are formed within the confines of the tool tray 2, each separated by divider walls 13. While the compartments 12 are depicted as being longitudinal and parallel, other compartment configurations may be designed and utilized if so desired.

Parallel end walls 14 enclose the upper tool tray 2, and a downturned lip flange 16 extends the periphery of the side walls 10 and end walls 14, along the upper rim of the tray 2. As shown in FIG. 1, a pair of spaced apart notches 17 extend into the portions of the downturned lip flange 16, extending along end walls 14.

As shown in FIGS. 1 and 3, a handle 18 extends upwardly from between side walls 10 and end walls 14. The handle 18 consists of a horizontal gripping portion 20 into which a longitudinal U-shaped groove 22 is formed. End walls 24 support opposite ends of the horizontal gripping portion 20, and extend upwardly from the bottom surface 8 of the tray to the upper gripping portion 20. As shown in FIG. 1, the handle 18 protrudes upwardly beyond the upward surface 6 of the tray 2, in the preferred embodiment. However, if so desired, the height of the handle 18 can be lowered below the top surface 6 of the tray 2, without detrimentally altering the function of the present invention.

The handle 18 is further provided with a downturned edge 26 as best viewed in FIG. 3. It will be appreciated that the downturned edge 26 is radiused along an outward surface for a purpose explained below. Extending upwardly through the bottom surface 8 of tray 2 is a profiled passageway 28. It will be appreciated that the horizontal gripping portion 20 and supportive end walls 24 define a hand opening 29 therebetween. Passageway 28 communicates with hand opening 29 as illustrated in FIG. 1.

The lower tray 4 is configured substantially similar to the upper tray 2. The lower tray 4 is defined by a top surface 30, a bottom surface 32, and side walls 34 extending vertically upward from the bottom surface 32 to the top surface 30. A plurality of compartments 36 are defined within the tray 4, separated by dividers 38. Some of the compartments, as shown, have concave bottom surfaces designed for containing small items such as tacks or nails. End walls 40 are provided to enclose the bottom tray 4, and a downturned lip flange 42 extends along the top edge of the end walls 40 and the side walls 34. Recessed into end portions of the lip flange 42 and extending along the end walls 40 are intermediate end recesses 44. Four corner protrusions 46 extend outwardly from the corners of the tray 4, for a purpose explained below.

As with the upper tray 2, the lower tray 4 has a handle 48 extending upwardly from between side walls 34, defined in part by a horizontal gripping portion 50. Horizontal gripping portion 50 is provided with edge flanges 56 which extend upwardly to define a U-shaped groove 52. The horizontal gripping portion 50 is supported at its ends by end walls 54 which extend upwardly from the bottom surface 32.

Figure 4:
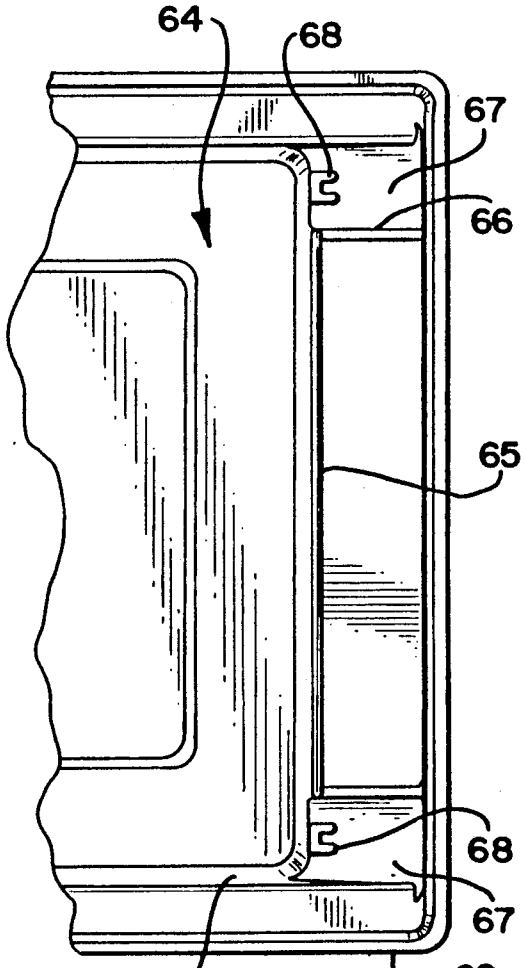
FIG. 4 is a partial top plan view of an empty toolbox configured so as to receive upper and lower tool trays configured according to the present invention.

Referring now to FIGS. 3 and 4, the trays 2, 4 are intended for receipt within a four-sided toolbox 60, open at the top and having an enclosure lid 62. As best seen in FIG. 4, the empty toolbox has a central chamber 64 extending downwardly from the top, between its side walls. At both ends of the toolbox 60 are rectangular compartments defined by a longitudinal vertical wall 65 and vertical end walls 66. The upper edges of the integrally molded walls 65 and 66 are coplaner. Situated adjacent to the end walls 66 are integrally molded inclined surfaces 67 which extend downwardly at a forty-five degree angle into the chamber 64. Situated at the lower end of surfaces 67, and extending outwardly in horizontal fashion therefrom are U-shaped molded bosses 68.

Figure 5:
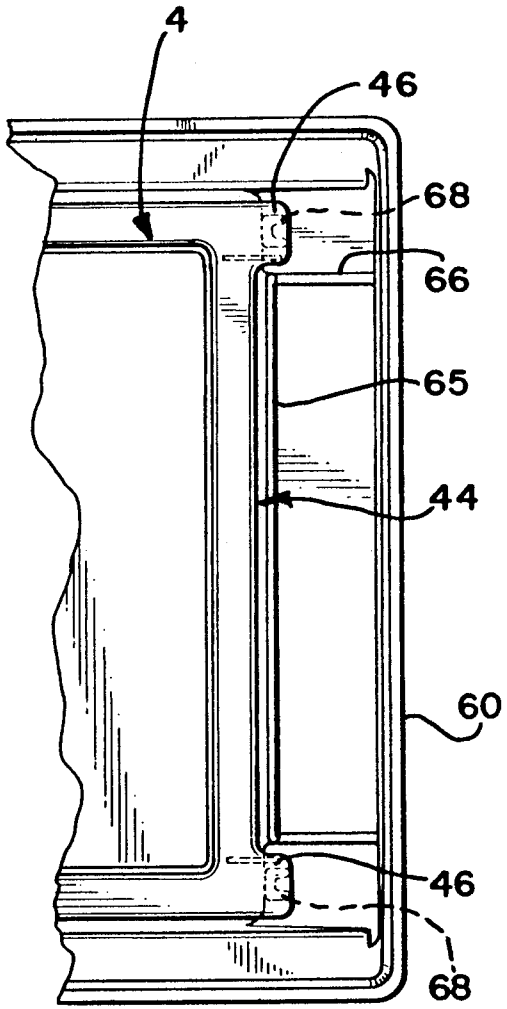
FIG. 5 is a partial top plan view of the toolbox showing the bottom tray in the storage position.

Use of the subject stacking trays and toolbox will be appreciated from the following. Referring initially to FIGS. 3, 4, and 5, the lower tray 4 can be placed within the confines of the central chamber 64 of toolbox 60, whereby corner protrusions 46 of tray 4 are supported by the boss protrusions 68. It will be appreciated from FIG. 5 that the recess 44 enables the lower tray 4 to clear vertical walls 65, 66, whereby reaching the lower confines of chamber 64 and achieving engagement with the bosses 68. So supported, the lower tray 4 is in a horizontal and stationary position at a relatively low level of central chamber 64.

Figure 6:
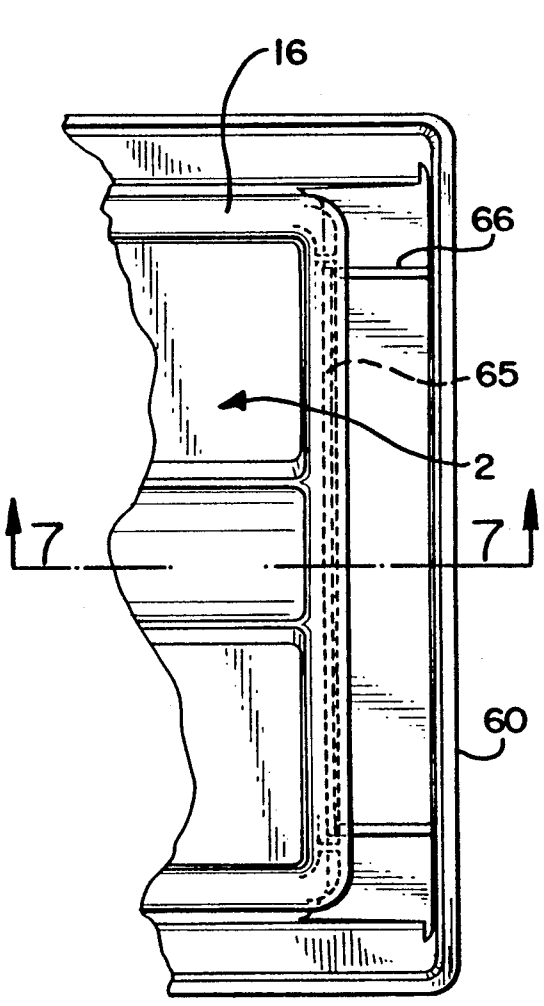
FIG. 6 is a partial top plan view of the toolbox showing the upper tray in its storage position within the toolbox.
Figure 7:
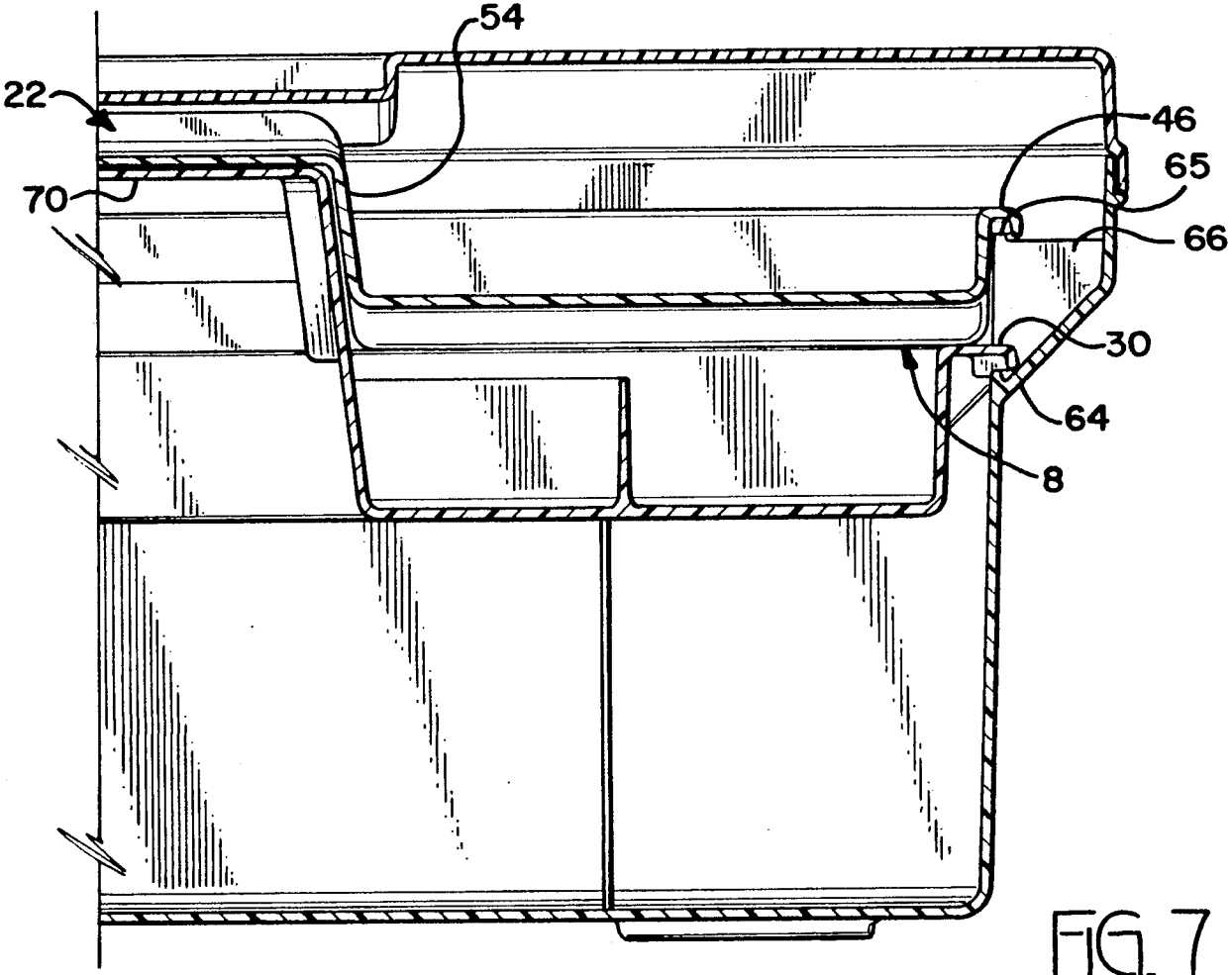
FIG. 7 is a longitudinal section view through the subject toolbox and tray assembly, illustrating positionment of the upper and lower trays within the toolbox in the storage position.

Receipt of the upper tray 2 within the box is illustrated by FIG. 6. As shown, the upper tray is supportedly received into the toolbox 60, as notches 17 in downturned edge flange 16 receive the end walls 66 of the toolbox 60. The upper tray 2 is therefore supported by the end walls 66 of toolbox 60, and held in a horizontal position within internal chamber 64. The positionment of the upper and lower trays in the stacked and stored positions is illustrated by FIGS. 3 and 7.

Figure 2:
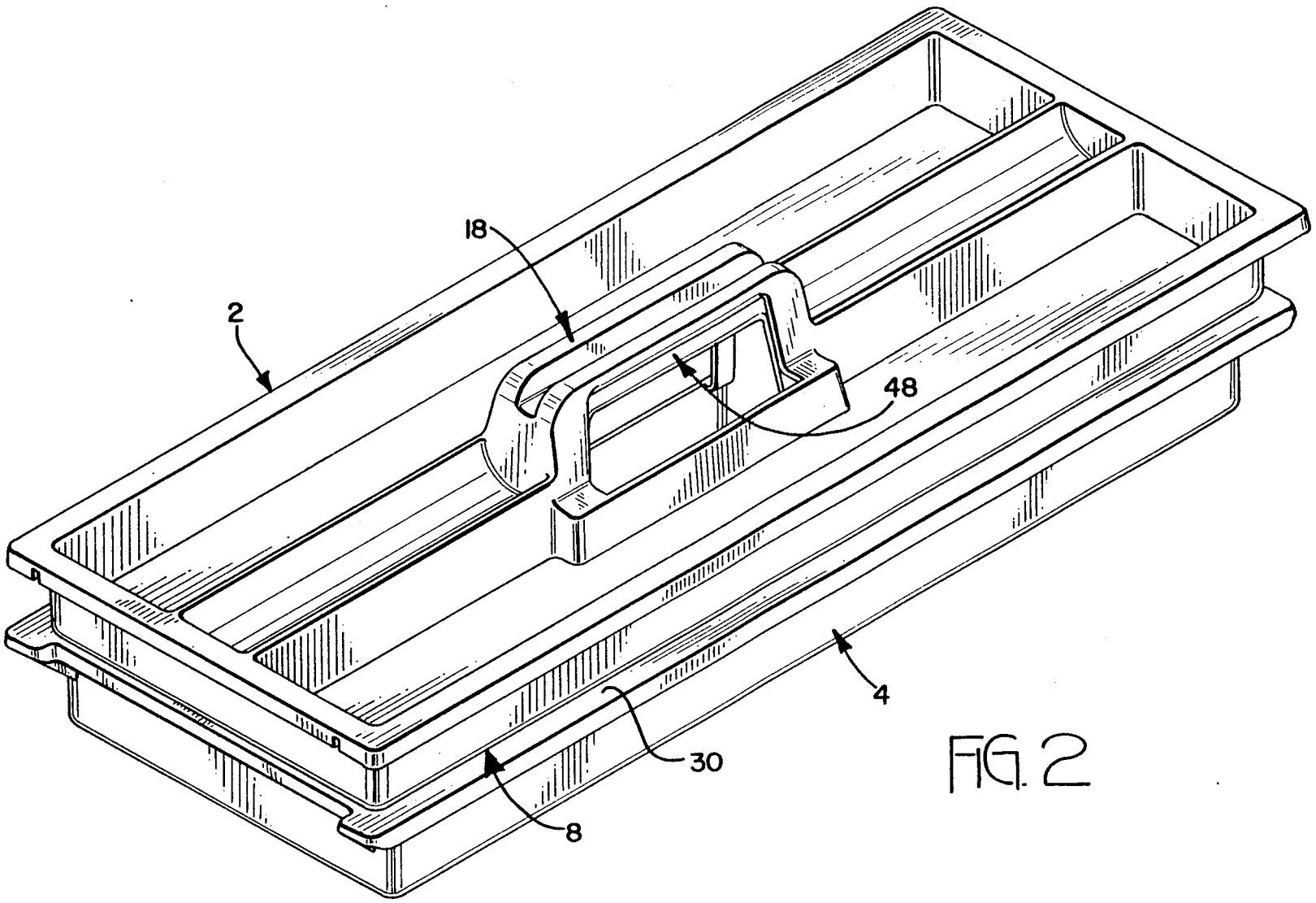
FIG. 2 is an assembled perspective view of the upper and lower trays comprising the subject invention.

As will be appreciated, the upper and lower trays 2 and 4 are intended to be stackable. As shown in FIGS. 1 and 2, as the trays are brought together, the handle 48 of the lower tray 4 protrudes through the profiled passageway 28 of the upper tray 2 until it nestingly receives the handle 18 of the upper tray 2. The U-shaped transverse sectional profile, of handles 18, 48 facilitate the nesting of the upper handle 18 within the lower handle 48, as illustrated by FIG. 3.

It will be appreciated that the downturned edge 26 of handle 18 is offset from the arcuate lower surface 70 of handle 48, by a gap 72. Penetration of gap 72 by a user's fingers enables the user to separate the handles and lift the top tray independently of the bottom. However, alternatively if so desired, the nesting arrangement between the U-shaped handles 18, 48 facilitates a simultaneous, single handed lifting of the trays.

As shown in FIG. 3, the outer surface of downward lip flange 26 and the arcuate surface 70 of the lower handle are complementarily radiused and cooperate to form a hand grip, whereby one hand can comfortably grip the two surfaces simultaneously. However, as explained above, the surfaces are separated by gap 72 such that separation of the handles can be easily and readily facilitated if so desired.

It will be apparent from FIG. 2 that the stacking trays can be transported from the toolbox storage condition of FIG. 3 to a remote work site. The stacking trays are free standing in the configuration shown in FIG. 2, as the lower surface 8 of the top tray 2 rests upon the top surface 30 of the lower tray 4. Furthermore, the bottom surface 8 of the top tray 2 entirely encloses the bottom tray 4 such that the contents of the compartments of tray 4 cannot spill out in transit, or mix from one compartment to another. Resultingly, the upper tray 2 serves a dual function; first as a lid for tray 2, and secondly as an independent storage tray.

While the above describes a preferred embodiment of the present invention, the scope of the subject invention is not to be so confined. Other embodiments, which will be obvious to those skilled in the art, and which utilize the teachings herein set forth are intended to be within the scope of spirit of the subject disclosure.

I claim:

1. A set of cooperative tool trays, comprising: first and second trays, each tray comprising a top and a bottom surface and side walls extending upwardly from said bottom surface to said top surface; an intermediately disposed profiled handle having an upper gripping portion and supportive end portions, and defining a hand opening below said gripping portion and between said end portions; and a profiled passageway extending through said bottom surface and communicating with said handle hand opening; said first tray being stackable upon the top surface of said second tray, and said second tray handle having a higher profile than said first tray handle, adapted to project through said profiled passageway of said first tray into close underlying proximity with said handle gripping portion of said first tray and adapted to bring said hand openings of said first and second trays into substantial co-alignment, whereby said handle gripping portions of said trays can be simultaneously lifted by said second tray handle in single handed fashion.

2. A tool tray set according to claim 1, wherein said first and second handle gripping portions having respectively sized upwardly opening U-shaped transverse sectional configurations, said first tray handle gripping portion being receivable between sidewalls of said second tray handle gripping portion in a nested condition.

3. A tool tray set according to claim 2, wherein said first and second handle gripping portions in said nested condition having offset surface means defining an opening therebetween for admitting a user's fingers for manual separation of said handle gripping portions.

4. A tool tray set according to claim 3, wherein said first and second trays are free standing in the stacked condition.

5. A tool tray set according to claim 4, further comprising a storage container having vertical side walls, and said trays being receivable into said container between said container side walls and having peripherally located means for engaging said container side walls, whereby said trays are simultaneously or, alternatively, individually removable from said container by a manual lifting of said trays by said handles.

6. A tool tray set according to claim 5, said simultaneous removal of said trays being by a manual lifting of said underlying handle gripping portion of said second tray.

7. A tool tray according to claim 6, wherein said bottom surface of said first tray substantially covering said second tray without diminishing an internal volumetric capacity of said second tray.

8. A toolbox and tray assembly comprising:

first and second trays, said first tray comprising a bottom and sidewalls extending upwardly from said bottom to a top surface, and interior sidewall surfaces extending form an interior floor surface to said top surface and defining with said floor surface an internal storage compartment;

and said first tray further comprising an intermediately disposed profiled passageway extending through said bottom and extending upwardly through said storage compartment;

said second tray comprising a bottom and sidewalls extending upwardly from said bottom to a top surface, and interior sidewall surfaces extending from an interior floor surface to said top surface and defining with said floor surface an interior storage compartment; said second tray further comprising an intermediately disposed profiled handle having an upper gripping portion and supportive end portions, and defining a hand opening below said gripping portion and between said end portions;

a lower surface portion of said first tray bottom having a dimension and configuration for stacking upon the top surface of said second tray, whereby said first tray bottom enclosing said second tray storage compartment, and said second tray handle having a height sufficient to project through said first tray passageway and above said first tray storage compartment, whereby both trays can b simultaneously lifted by said second tray handle in single handed fashion;

a toolbox having spaced apart sidewalls and a floor surface defining a top opening tool tray receiving chamber therebetween, and tray support means in said toolbox sidewalls for supportively engaging said first ray within said toolbox chamber; and said trays being simultaneously receivable in said toolbox chamber in a stacked condition and simultaneously removable therefrom by a manual lifting of said trays by said second tray handle.

9. An assembly according to claim 8, wherein said first tray bottom covers said second tray storage compartment in a substantially non-intrusive manner with said first tray stacked upon said second tray.

10. An assembly according to claim 9, wherein said second tray storage compartment having divider panels therein for defining multiple sub-compartments for segregated storage of different articles.

11. An assembly according to claim 10, wherein said first tray storage compartment having divider panels therein for defining multiple sub-compartments for segregated storage of different articles.

12. An assembly according to claim 11, wherein said second tray top surface comprising a horizontal rim flange extending about an upper peripheral edge of said second tray sidewalls.

13. A stackable tool tray assembly comprising:

a first tray comprising a bottom and sidewalls extending upwardly from said bottom to a top surface, and interior sidewall surfaces extending from an interior floor surface to said top surface and defining with said floor surface an internal storage compartment; said first tray further comprising an intermediately disposed profiled passageway extending through said bottom and extending upwardly through said storage compartment;

a second tray comprising a bottom and sidewalls extending upwardly from said bottom to an upper rim, and a horizontal rim flange extending outwardly from said upper rim, and interior sidewall surfaces extending from an interior floor surface to said top surface and defining with said floor surface an interior storage compartment, and an intermediately disposed profiled handle having an upper gripping portion and supportive end portions, and defining a hand opening below said gripping portion and between said end portions;

a lower surface portion of said first tray bottom having a dimension and configuration for stacking upon said horizontal rim flange of said second tray whereby said first tray bottom enclosing said second tray compartment, and said second tray handle having a height sufficient to project through said first tray passageway and above said first tray storage compartment, whereby both trays can be simultaneously lifted by said second tray handle in single handed fashion.

14. An assembly according to claim 13, wherein said first tray bottom covers said second tray storage compartment in a non-intrusive manner with said first tray stacked upon said second tray.

15. An assembly according to claim 14, further comprising a toolbox having spaced apart sidewalls and a floor surface defining a top-opening tool tray receiving chamber therebetween, and tray support means in said toolbox sidewalls for supportively engaging said first tray within said toolbox chamber; said trays being simultaneously receivable in said toolbox chamber in a stacked condition and simultaneously removable therefrom by a manual lifting of said trays by said second tray handle.

16. An assembly according to claim 15, wherein said second tray storage compartment having divider panels therein for defining multiple sub-compartments for segregated storage of different articles.

17. An assembly according to claim 16, wherein said first tray storage compartment having divider panels therein for defining multiple sub-compartments for segregated storage of different articles.

* * * * *